United States Patent [19]

Gabr

[11] 4,176,253

[45] Nov. 27, 1979

[54] CURRENT LOADED PNEUMATICALLY DRIVEN LOUDSPEAKER ARRANGEMENTS

[76] Inventor: Saad Z. M. Gabr, 81 Old Dover Rd., Canterbury, Kent, England

[21] Appl. No.: 901,147

[22] Filed: Apr. 28, 1978

Related U.S. Application Data

[63] Continuation-in-part of Ser. No. 827,313, Aug. 24, 1977, abandoned.

[30] Foreign Application Priority Data

May 20, 1977 [GB] United Kingdom ..... 21383/77

[51] Int. Cl.[2] ..... H04R 1/22; H04R 1/24; H04R 3/12

[52] U.S. Cl. ..... 179/1 E

[58] Field of Search ..... 179/1 E

[56] References Cited

U.S. PATENT DOCUMENTS

| | | | |
|---|---|---|---|
| 2,403,232 | 7/1946 | Parisier | 179/1 J |
| 3,155,774 | 11/1964 | Howell | 179/1 E |
| 3,275,758 | 9/1966 | Bryan et al. | 179/180 |
| 3,612,741 | 10/1971 | Marshall | 179/1 J |
| 3,772,466 | 11/1973 | Hossbach | 179/116 |

FOREIGN PATENT DOCUMENTS

| | | | |
|---|---|---|---|
| 1045117 | 11/1958 | Fed. Rep. of Germany | 179/1 J |
| 2552591 | 5/1977 | Fed. Rep. of Germany | 179/1 E |
| 2327697 | 5/1977 | France | 181/163 |
| 484704 | 5/1938 | United Kingdom | 181/156 |

*Primary Examiner*—George G. Stellar
*Attorney, Agent, or Firm*—Young & Thompson

[57] ABSTRACT

Electro-acoustic transducer arrangement are disclosed in which the tendency to diaphragm distortion between the drive and suspension positions is reduced and the efficiency as well as linear characteristics are improved especially at lower frequencies. A loudspeaker arrangement has an externally electrically driven transducer and one or more additional transducers pneumatically coupled therewith. Such additional transducer or transducers can be suspended in the same chassis as the electrically driven transducer. An additional transducer can be suspended in a separate chassis in the same enclosure as the electrically driven transducer or in a separate enclosure connected by an acoustic transmission line with that containing the electrically driven transducer. A pneumatically driven diaphragm can actuate an electromechanical transducer the output of which is used to drive another transducer and/or to modify or control its own movement and/or that of the diaphragm of the electrically driven transducer. The relative sizes of the transducer diaphragms, their weights, their form, their suspension, the voice coil, size, weight and impedance, as well as the load values applied to the voice coils and the field strength of the associated magnet systems, will determine the frequency ranges handled by each of the pneumatically operated transducers. In this and various other embodiments of the invention, these factors are distinctively different among the various speakers, with the result that the frequency ranges of the various speakers will be different, although they may overlap. Thus the driven speaker may have a full frequency range, while the pneumatic one or ones may correct e.g. the bass or the top. The pneumatic speaker or speakers control the acoustical characteristics of the enclosure or cabinet, to improve efficiency at specific frequencies, which can be narrow bands or wide bands.

3 Claims, 3 Drawing Figures

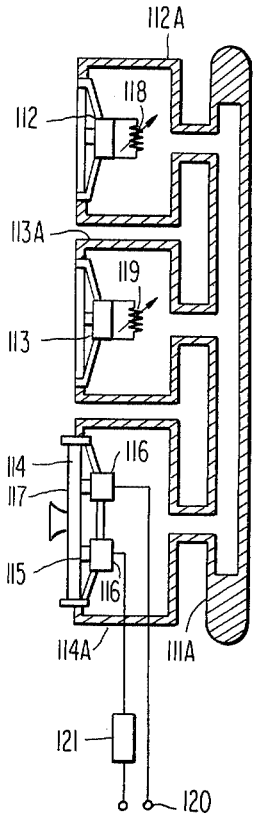
FIG. 2
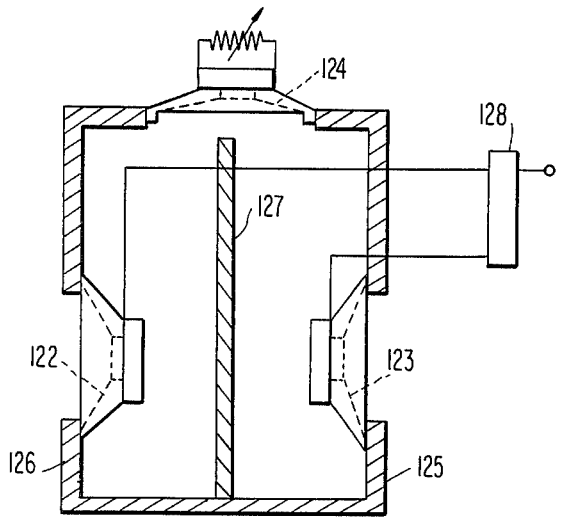
FIG. 3
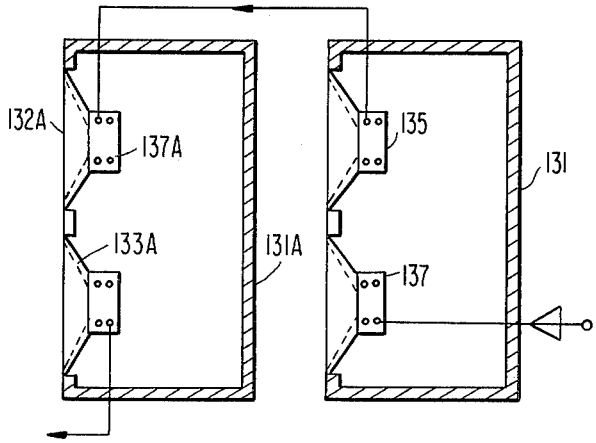

CURRENT LOADED PNEUMATICALLY DRIVEN LOUDSPEAKER ARRANGEMENTS

This application is a continuation-in-part of my copending application Ser. No. 827,313, filed Aug. 24, 1977 and now abandoned.

The invention relates to electro-magnetic-acoustic transducers.

An object of the invention is to provide an electro-acoustic transducer in which the efficiency of the energy conversion shows a substantial improvement over conventional units, and in which there are provided separate diaphragm surfaces adequate to give special responses to specified frequency ranges, the transducer having better dynamic characteristics than conventional units.

A further object of the invention is to provide a loudspeaker unit with improved power handling capacity per unit area of the overall area of the loudspeaker chassis, as compared with conventional units.

Yet another object of the invention is to provide electro-acoustic transducer units capable of effecting a substantial reduction in manufacturing costs, as compared with conventional units, as well as a reduction in costs per unit of power handled by units of the invention.

These and other objects and advantages of the present invention will be more readily understood from the following description, which is given for purposes of illustration and not by way of limitation, taken in connection with the accompanying drawings, in which:

FIG. 1 is a sectional side view of a loudspeaker system embodying the invention;

FIG. 2 is a like view of a further loudspeaker system embodying the invention; and FIG. 3 is a like view of a still further loudspeaker system embodying the invention.

The loudspeaker device of the invention shown in FIG. 1 comprises three loudspeaker units 112, 113 and 114. The diaphragms of the units 112 and 113 are pneumatically driven by the unit 114 which has a diaphragm 115 driven by a plurality of electro-mechanical transducers 116, and a passive radiator diaphragm 117, provided with an outwardly flaring conical center piece, the diaphragms 115 and 117 being coupled together by the air within a sealed chamber between them.

The diaphragms of the units 112 and 113 carry the moving coils of electro-mechanical transducers 118, 119 respectively, which can be used to supply or receive signals for damping or control purposes. The coils of the electro-mechanical transducers 118, 119 can instead or as well be supplied with signals within respective frequency band widths selected from the input signal to be reproduced as sound by the device as a whole. In this way each of the units 112, 113 receives both a pneumatic input covering the entire frequency range to be reproduced, and an electrical signal in a lesser frequency range therewithin.

As schematically shown in FIG. 1, a full frequency range audio input at 120 is supplied directly to the transducers 116 through a multi-section filter means 121. Transducers 118, 119 are pneumatically coupled. It will be understood that the voice coil formers of the electro-mechanical transducers of FIG. 1 carry as many separate coils as are required.

Transducers 118 and 119 are variably loaded.

The units 112, 113 and 114 are mounted in respective enclosures 112A, 113A and 114A. The interiors of these enclosures are in communication by way of a duct 111A which may be flexible but which may be constituted by a rigid tube or tubes by which the enclosures can be suitably located for use. The duct 111A can for example comprise a pair of telescopically related tubes with spring means acting between them so that their ends can be urged into engagement with opposed walls or between a ceiling and a floor. The connections between the duct and the enclosures can be such as to permit selection of a desired orientation of each enclosure to the duct.

The relative sizes of the transducer diaphragms, their weights, their form, their suspension, the voice coil size or weight or impedance, as well as the load values applied to the voice coils or the field strength of the associated magnet systems, will determine the frequency ranges handled by each of the pneumatically operated transducers. In this and various other embodiments of the invention, these factors are distinctively different among the various speakers, with the result that the frequency ranges of the various speakers will be different, although they may overlap. Thus the driven speaker may have a full frequency range, while the pneumatic one or ones may correct e.g. the bass or the top. The pneumatic speaker or speakers control the acoustical characteristics of the enclosure or cabinet, to improve efficiency at specific frequencies, which can be narrow bands or wide bands.

In the loudspeaker system 126 of the invention shown in FIG. 2, three loudspeaker diaphragms 122, 123 and 124 are mounted each in a respective wall of an enclosure 125. An internal baffle 127 provides substantial acoustic separation between the diaphragms 122 and 123 but allows each to be in communication with the diaphragm 124. The diaphragms are in this system provided by conventional loudspeaker units but one or more electro-acoustic transducers of the present invention can be used, and extra coils on the voice coil former are required if control signals are to be applied in addition to signals to be reproduced.

The signal supply arrangements provided for the system of FIG. 1 can be employed with that of FIG. 2 and there may be provided also as shown in FIG. 2, switching means 128 to enable the user to select which of the units is to function as the motor unit.

In any loudspeaker system of the invention, the physical positioning of the various diaphragms is chosen with reference to the phase differences introduced by the transmission of sound between them and the frequency range which it is intended that the outwardly radiating diaphragm or diaphragms should handle. The motor diaphragm can but need not itself have a surface exposed to the exterior of the enclosure.

The use in accordance with the invention of the signals obtained from an electro-acoustic transducer operated by a pneumatically driven diaphragm is now further described with reference to FIG. 3.

The voltage generated in an electro-acoustic transducer associated with a pneumatically driven diaphragm can be used additionally or instead to drive a further loudspeaker unit. As shown in FIG. 3, the electrical output of the coil 135 in a first enclosure 131, whose loudspeaker is pneumatically driven by an electrically driven loudspeaker whose coil is shown at 137 is taken to the voice coil 137A of a loudspeaker unit 132A mounted in a second enclosure 131A, which also mounts a diaphragm 133A pneumatically coupled with the diaphragm of the unit 132A. The drive to the loudspeaker system of the enclosure 131A is thus electrical but the electrical signal is obtained through a pneumatic coupling in the enclosure 131. The system comprising the two enclosures 131 and 131A can of course be extended by addition of further enclosures, and the enclosures can be in adjacency or physically spaced. Switching means can be provided to permit selection as to which of the enclosures receives the original signal input.

It will be noted from FIGS. 1 and 3, that the plural diaphragms face the same way. This is a preferred feature of the present invention.

It is to be understood that the provision of pneumatically driven diaphragms in accordance with the present invention is not confined to loudspeaker systems concerned only with the reproduction of signals at the lower end of the audio frequency range. The additional diaphragms of the invention can be employed in conjunction with loudspeaker units which handle either the entire audio frequency range, or any selected part of it.

The or each electro-acoustic transducer unit and the or each additional radiator of the loudspeaker systems described, or of conventional systems, can be constructed with a diaphragm formed conventionally from sheet material. The diaphragm design is preferably such as to minimize weight and aerodynamic resistance to movement and to maximize rigidity and thus resistance to distortion in use.

I claim:

1. A loudspeaker assembly comprising a first enclosure, first and second loudspeakers each having a diaphragm means, each said first and second loudspeaker being different from the other as to the frequency range to which it responds and as to its efficiency at various frequencies, means mounting said first and second loudspeakers in said first enclosure with said diaphragm means thereof pneumatically coupled together within said first enclosure, an electro-mechanical transducer driven by said diaphragm means of said second loudspeaker, a second enclosure, a third loudspeaker having a diaphragm means, means mounting said third loudspeaker in said second enclosure, means for applying an electrical input to said first loudspeaker, and means for supplying the electric output of said electro-mechanical transducer to drive said third loudspeaker, said second loudspeaker being driven solely by said pneumatic coupling of said diaphragm means of said first and second loudspeakers, said diaphragm means of said first, second and third loudspeakers being exposed to the outside of said first and second enclosures.

2. A loudspeaker assembly having chassis means, a first loudspeaker comprising first diaphragm means, first means suspending said first diaphragm means in said chassis means, electro-mechanical transducer means adapted to act between said first diaphragm means and said chassis means, a second loudspeaker comprising second diaphragm means, second means suspending said second diaphragm means in said chassis, said first and second diaphragm means being acoustically exposed to each other in the interior of a closed chamber within said chassis means, said transducer means driving said first diaphragm means and said first diaphragm means pneumatically driving said second diaphragm means and being the sole drive of said second diaphragm means, a current-consuming device loading said second diaphragm means, and a partition subdividing said chamber into two compartments one individual to each said diaphragm means, said compartments communicating directly with each other past said partition within said chamber.

3. A loudspeaker assembly as claimed in claim 2, said first and second loudspeakers differing from each other as to the frequency ranges to which they respond and as to their efficiency at various frequencies.

* * * * *